US005697037A

United States Patent [19]

Yano et al.

[11] Patent Number: 5,697,037

[45] Date of Patent: Dec. 9, 1997

[54] FIXING DEVICE AND FILM FOR USE IN IT

[75] Inventors: Hideyuki Yano; Yasumasa Ohtsuka; Mahito Yoshioka, all of Yokohama; Naoki Konishi, Omihachiman; Masafumi Matsumura, Kusatsu, all of Japan

[73] Assignees: Canon Kabushiki Kaisha, Tokyo; I.S.T. Corporation, Otsu, both of Japan

[21] Appl. No.: 595,079

[22] Filed: Feb. 1, 1996

[30] Foreign Application Priority Data

Feb. 8, 1995 [JP] Japan ..... 7-020785

[51] Int. Cl.[6] ..... G03G 15/20

[52] U.S. Cl. ..... 399/333; 399/335; 399/338

[58] Field of Search ..... 355/282, 285, 355/289, 290, 295; 430/97, 99; 399/320, 330, 333, 328, 335, 338

[56] References Cited

U.S. PATENT DOCUMENTS 4,272,179 6/1981 Seanor .
4,819,020 4/1989 Matsushiro et al. .
5,061,965 10/1991 Ferguson et al. ..... 430/99 X
5,153,654 10/1992 Yuminamochi et al. .
5,177,549 1/1993 Ohtsuka et al. .
5,182,606 1/1993 Yamamoto et al. .
5,264,902 11/1993 Suwa et al. .
5,287,153 2/1994 Senba .
5,332,641 7/1994 Finn et al. ..... 430/99 X
5,376,996 12/1994 Sankaran .
5,401,936 3/1995 Kusaka et al. .
5,471,288 11/1995 Ohtsuka et al. .

FOREIGN PATENT DOCUMENTS 0372518 6/1990 European Pat. Off. .

*Primary Examiner*—Sandra L. Brase
*Attorney, Agent, or Firm*—Fitzpatrick, Cella, Harper & Scinto

[57] ABSTRACT

In a fixing device for heating and melting a toner image and fixing it onto a transfer material, the fixing device has a fixing member surface which comes in contact with a toner image. The fixing member surface has at least a resin and an ion-conductive electrical resistance value controlling material having a melting point higher than a maximum temperature in the fixing device.

15 Claims, 3 Drawing Sheets

FIXING DEVICE AND FILM FOR USE IN IT

BACKGROUND OF THE INVENTION

1. Field of the Invention

The present invention relates to a fixing device, particularly a fixing device suitable for electrophotography, and a film for use in the fixing device. More specifically, it relates to a fixing device which is excellent in offset prevention.

2. Related Background Art

Heretofore, as a fixing device of an electrophotographic apparatus such as a printer or a duplicator, a heated roller system has been used. In this system, a transfer material having a toner image is passed through a fixing nip formed between a fixing roller having a heat source such as a halogen heater therein and a press roller for applying pressure onto the transfer material, whereby the toner is fixed on the transfer material with the aid of the heat and the pressure. This system has been used for a long period of time because of a simple constitution and a high speed, but it simultaneously has a problem that preheating is necessary even at stand-by where printing is not carried out, and another problem that heat capacity is large and so a long wait is required.

On the contrary, in recent years, an on-demand type fixing device comprising the combination of a ceramic heater having a small heat capacity and a film (the heater is usually in an off state, and when a paper has been fed, the heater is switched on) has been put to practical use. In this on-demand type fixing device, its heat capacity is reduced to shorten the wait, and when a print signal has been received, the fixing device is switched on.

In both of the heated roller system and the on-demand system, however, an electrostatic offset phenomenon that the toner on the transfer material is electrostatically transferred to the fixing roller or a fixing film tends to occur inconveniently, which deteriorates an image quality.

In the on-demand type fixing device, an electric field for attracting the toner on the transfer material to the fixing film is generated by frictional charging between the transfer material and the fixing film or transfer charges on the transfer material, so that a part of the toner is transferred onto the fixing film inconveniently. The transferred toner is returned to the transfer material when the fixing film has been turned once, and in consequence, the toner becomes a ghost on the image. This phenomenon is called the electrostatic offset.

The electrostatic offsets can be roughly classified into a total surface offset and a peeling offset on the basis of occurrence manners. In the total surface offset, charges are transferred between the transfer material and the fixing film by the frictional charging or the like, so that an offset field is always generated, with the result that the offset continuously appears all over the image. On the other hand, the peeling offset takes place as follows. When the transfer material passes through the fixing device, the rear end of the transfer material rebounds to strongly come in contact with the fixing film, so that a potential history longitudinally remains in the state of a straight line, which potential causes the offset. Thus, the peeling offset occurs in the state of the straight line in a scanning direction on the image, and therefore both the offset phenomenons can be distinguished from each other.

In order to prevent these electrostatic offsets, the potential of the fixing film has been heretofore controlled so as to be at a constant level. Concretely, in the case that the negatively charged toner is used, the fixing film has been treated not to be positively charged, or alternatively, the fixing film is electrified and connected to an earth so that the potential of the fixing film may keep 0 V.

Furthermore, in order to actively suppress the electrostatic offsets, a means has also been used in which a diode is interposed between the fixing film and the earth to forcedly form an electric field for preventing the offsets.

In general, the prevention of the charging on the surface of the fixing film can be accomplished by decreasing the surface resistance of a surface layer material of the fixing film. Concretely, the decrease in the surface resistance can be done by adding carbon to a release layer of the surface layer of the fixing film.

The surface layer of the fixing film is required to have heat resistance and high release properties. In order to meet this requirement, the surface layer of the conventional fixing film has been formed from a mixture of a dispersion such as tetrafluoroethylene-perfluoroalkylvinyl ether copolymer (PFA) or polytetrafluoroethylene (PTFE) and carbon. The surface potential of the fixing film formed by such a technique was measured by a surface electrometer during the feed of papers, and it was confirmed that the surface potential was as low as about several tens V and hence the charging was effectively prevented.

However, even when the film having such a surface potential is used, the electrostatic offset appears on occasion, and when the structural conditions of the fixing film alter by a certain factor, the electrostatic offset noticeably appears sometimes, though the surface potential of the fixing film is sufficiently low.

The resistance of the fixing film is preferably low to control the electric field for generating the offset, but if it is too low, a trouble, i.e., the leakage of the transfer charges takes place. That is to say, the transfer charges which are held by the transfer material are released, so that the force for attracting the toner to the transfer material weakens, which results in the occurrence of the electrostatic offset.

In order to prevent this phenomenon, the surface resistance of the fixing film is required to be $1\times10^6$ Ω/□ or more. The acquisition of this resistance value has been heretofore accomplished usually by optimizing the amount of a conductive material, i.e., carbon which is added to the surface layer of the fixing film. For example, the adjustment of the surface resistance of the film to about $1\times10^{10}$Ω/□ can be carried out by adding a slurry obtained by dispersing KETJEN BLACK (a kind of carbon black) in water to the fixing film in an amount of 0.7% by weight based on the weight of a fluorine-containing resin.

However, the resistance value noticeably alters by the viscosity and the pH value of a coating solution at the time of manufacture, the dispersion state of carbon, changes of some factors with time and the like, and for this reason, it is difficult to control the resistance value of the film to a certain level. Therefore, the range of the requirements which permits the prevention of the total surface offset and the charging is limited, and it has been difficult that the manufacturing process of the fixing film is compatible with the prevention of these phenomenons.

SUMMARY OF THE INVENTION

The present invention has been intended to solve the above-mentioned conventional problems, and an object of the present invention is to provide a fixing device for preventing the generation of an electrostatic offset and for decreasing the fluctuation of a resistance value at the manufacture of a fixing film.

Another object of the present invention is to provide a film for use in the above-mentioned fixing device.

For the achievement of the above-mentioned objects, a fixing device according to the present invention has a fixing member surface which comes in contact with a toner image, the fixing member surface comprising at least a resin and an ion-conductive electrical resistance value controlling material having a melting point higher than a maximum temperature in the fixing device.

The ion-conductive material can be uniformly dispersed in the resin, and therefore there can be prevented the positional fluctuation of the resistance value which is caused by the localization of the electrical resistance value controlling material in the fixing member surface, whereby the electrostatic offset can be prevented. Furthermore, in the ion-conductive material, carriers for carrying charges are ions, and hence, moisture has a larger influence on the carriers than in an electron-conductive material such as carbon black. However, when the carriers are applied to the fixing device, they are heated during operation, so that such an influence is not present and a stable performance can be exerted.

DETAILED DESCRIPTION OF THE INVENTION

Figures 1A, 1B, 1C:
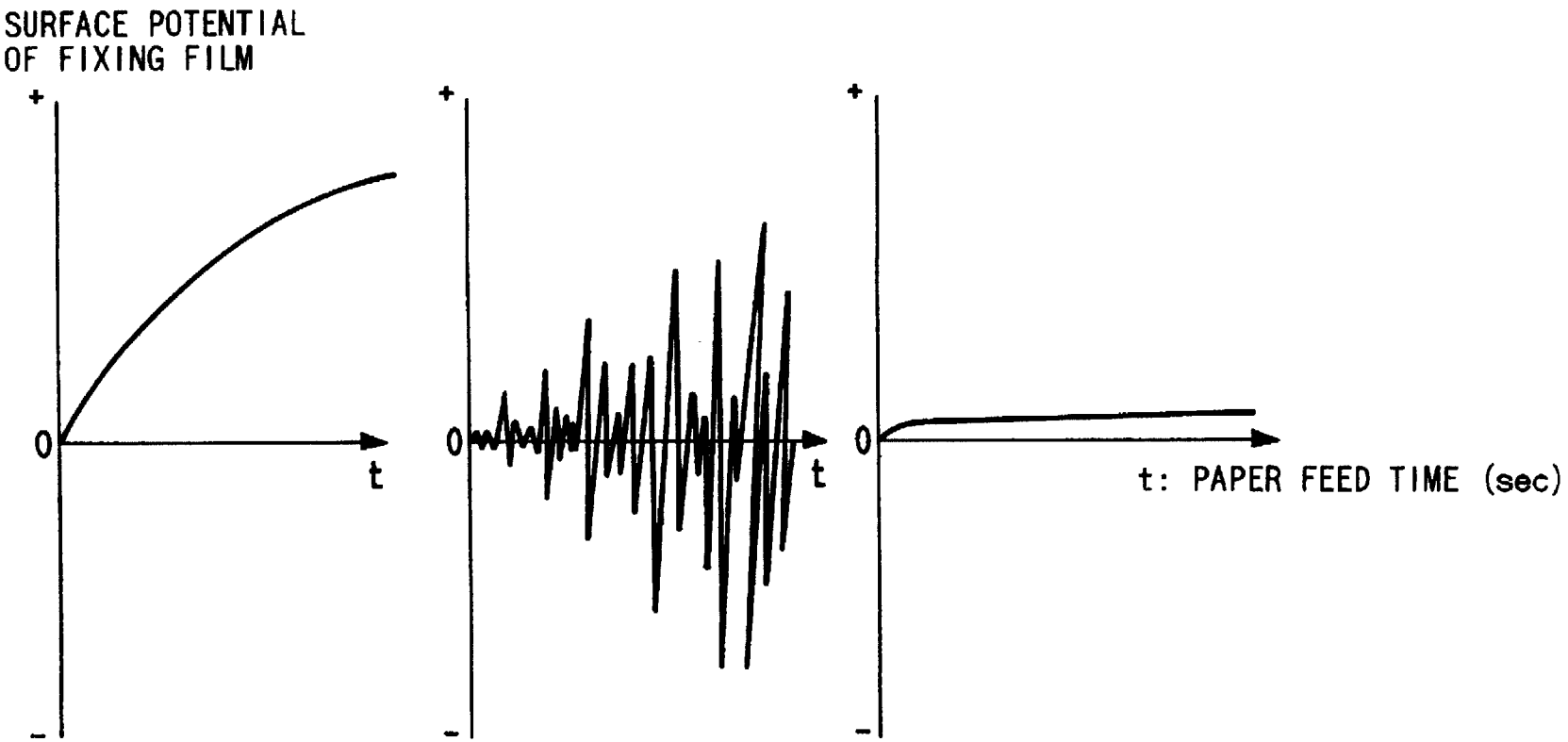
FIGS. 1A to 1C show the unevenness of electrical potential in the surface of a fixing film regarding one embodiment of the present invention.

A fixing device according to the present invention is constituted of a heating apparatus comprising a film and a heater and a press roller having an elastic portion, and the surface of the film preferably comprises at least a resin and an ion-conductive electrical resistance value controlling material having a melting point higher than a maximum temperature in the fixing device.

Another fixing device according to the present invention is a heated roller fixing device, and the surface of the heated roller preferably comprises at least a resin and an ion-conductive electrical resistance value controlling material having a melting point higher than a maximum temperature in the fixing device.

The ion-conductive material is preferably at least one selected from the group consisting of organic phosphorus salts and organic salts containing a perfluoroalkyl group.

Examples of the organic phosphorus salts which can be used in the present invention include diphenyl phosphite, triethyl phosphite, triphenyl phosphite, decyl.diphenyl phosphite, (nonylphenyl and dinonylphenyl mixing) triphosphite, triphenyl phosphate, triethyl phosphate, tri (butoxyethyl) phosphate, hexamethylphosphonic amide, dimethyl phosphonate, phosphine oxide, alkylphosphine oxide, alkylphosphine sulfide and phosphonium salts, and they may be used singly or in a combination thereof.

Usable examples of the organic salts containing the perfluoroalkyl group include $RfSO_3M$ (wherein Rf is a perfluoroalkyl group, and an alkyl group R has 1 to 30 carbon atoms, and M is an alkali metal or an alkaline earth metal; which shall apply to the undermentioned chemical formulae), $RfSO_3NH_4$, $RfSO_2NRCH_2$ COOM, $RfSO_2N(R)C_2H_4OH$, $RfSO_2N(R)(C_2H_4O)_nH$ (wherein n is in the range of 1to 30), $(RfSO_2N(R)C_2H_4O)_2PO(OH)$, $(RfSO_2N(R)C_2H_4O)_2PO(ONH_4)$, $RfSO_2N(R)C_2H_4OSO_3H$, $RfSO_2N(R)C_2H_4OSO_3M$, $RfSO_2N(R)C_2H_4OCOC_6H_5$, $RfSO_2N(R)CH_2COOC_2H_5$, $RfSO_2N(H)C_3H_6N^+(CH_3)_3I^-$, $RfCOONH_4$, $RfSO_2N(CH_2—C_6H_5)C_2H_4OH$ and $RfSO_2NC_3H_6N^+(CH_3)_2C_2H_4COO^-$.

The ion-conductive electrical resistance value controlling material is preferably dispersed in the resin in an amount of 0.1 to 40% by weight based on the weight of the resin.

Furthermore, the surface electrical resistance of the fitting member is preferably in the range of $1\times10^6$ Ω/□ ~ $1\times10^{14}$ Ω/□, and it has an antistatic function.

With regard to the constitution in which the resin and the ion-conductive electrical resistance value controlling material are applied onto the surface of the fixing number, the whole fixing member may be constituted of the resin and the ion-conductive material, but particularly preferably, a surface layer containing the resin and the ion-conductive material is mounted on the surface of the fixing member. In this case, a substrate on which the surface layer is mounted is preferably a heat-resistance film such as polyimide, polyamide or polyphenylene oxide.

The thickness of the surface layer is preferably in the range of 1 to 50 μm.

As the resin in which the ion-conductive material is uniformly dispersed, there can be used a heat-resistance resin which can withstand a temperature (e.g., 180° C.) more than a temperature at the time of fixing. Examples of such a resin include fluorine-containing resins, polyimide resins, polyamidoimide resins, silicone resins, polybenzimidazol resins, polyphenylene oxide resins and polybutylene terephthalate resins. Above all, the flourine-containing resins are preferable.

Examples of the flourine-containing resins include polytetrafluoroethylene (PTFE), tetrafluoroethylene-perfluoroalkylvinyl ether copolymer (PFA) and tetrafluoroethylene-hexafluoropropylene copolymer (FEP).

According to the constitution of the present invention, a fixing member surface material which comes in contact with a toner image of the fixing device for heating and melting the toner image and fixing it on a transfer material contains at least an ion-conductive electrical resistance value controlling material having a melting point higher than a maximum temperature in the fixing device, whereby there can be realized the fixing device of an electrophotographic apparatus which is capable of preventing the generation of an electrostatic offset and capable of reducing the fluctuation of a resistance value in the manufacture of the fixing film. That is to say, the thus contained ion-conductive electrical resistance value controlling material can be uniformly mixed with a resin constituting the fixing film or the surface layer of a fixing roller, so that electric charges in the surface can be removed therefrom and the proper resistance value can be given. For example, when the ion-conductive electrical resistance value controlling material is dispersed in a fluorine-containing resin dispersion, the resistance value controlling material is ionized and dispersed in the fluorine-containing resin dispersion, and in the case that this fluorine-containing resin dispersion containing the resistance value controlling material is then used to form a film, the resistance value controlling material can be uniformly diffused all over the film without the localization of the same, so that a surface resistance value can be obtained in a very uniform state. According to this manner, there can be prevented the unevenness of the dispersion and the nonuniformity of the surface resistance which are involved in an electron-conductive resistance value controlling material which a filler such as carbon or a metallic oxide is added to and dispersed in to deteriorate the resistance value, and in consequence, the generation of the electrostatic offset can be prevented. Furthermore, the ion-conductive electrical resistance value controlling material usually has a problem that its electrical resistance value largely changes owing to the temperature and moisture on its material surface, but if the ion-conductive electrical resistance value controlling material is used as the fixing film or the fixing roller, the surface of the material is constantly controlled to a fixing temperature during printing, so that it can be used without the influence of the temperature and moisture.

According to an embodiment in which the fixing device is constituted of an elastic press roller and a heating apparatus comprising a seamless film and a heater, and the surface layer of the seamless film contains at least the resin and the ion-conductive electrical resistance value controlling material having the melting point higher than the maximum temperature which the fixing device uses, a preferable antistatic function can be imparted to, for example, the seamless film or the surface layer made of a substantially electrically insulating resin such as a polyimide film, whereby charging can be prevented even when the seamless film or the surface layer comes in contact with printing papers which are being passed, and the generation of the electrostatic offset can be effectively prevented.

Furthermore, according to a preferable embodiment in which the fixing device is a heated roller fixing device and the surface layer of the heated roller contains at least the resin and the ion-conductive electrical resistance value controlling material having the melting point higher than the maximum temperature which the fixing device uses, a preferable antistatic function can be imparted to, for example, the heated roller comprising a metal roller and a surface layer mounted on its surface or the heated roller comprising a metal roller, a silicon rubber layer mounted on its surface and a surface layer further mounted thereon, whereby charging can be prevented even when the heated roller comes in contact with printing papers which are being passed, and the generation of the electrostatic offset can be effectively prevented.

If the ion-conductive material is at least one selected from the group consisting of organic phosphorus salts and organic salts having perfluoroalkyl groups, the preferable antistatic function can be imparted. Examples of the organic salts having the perfluoroalkyl groups include sulfonates, ammonium salts and carboxylates.

Next, the present invention will be described in more detail in comparison with conventional examples.

Figure 5:
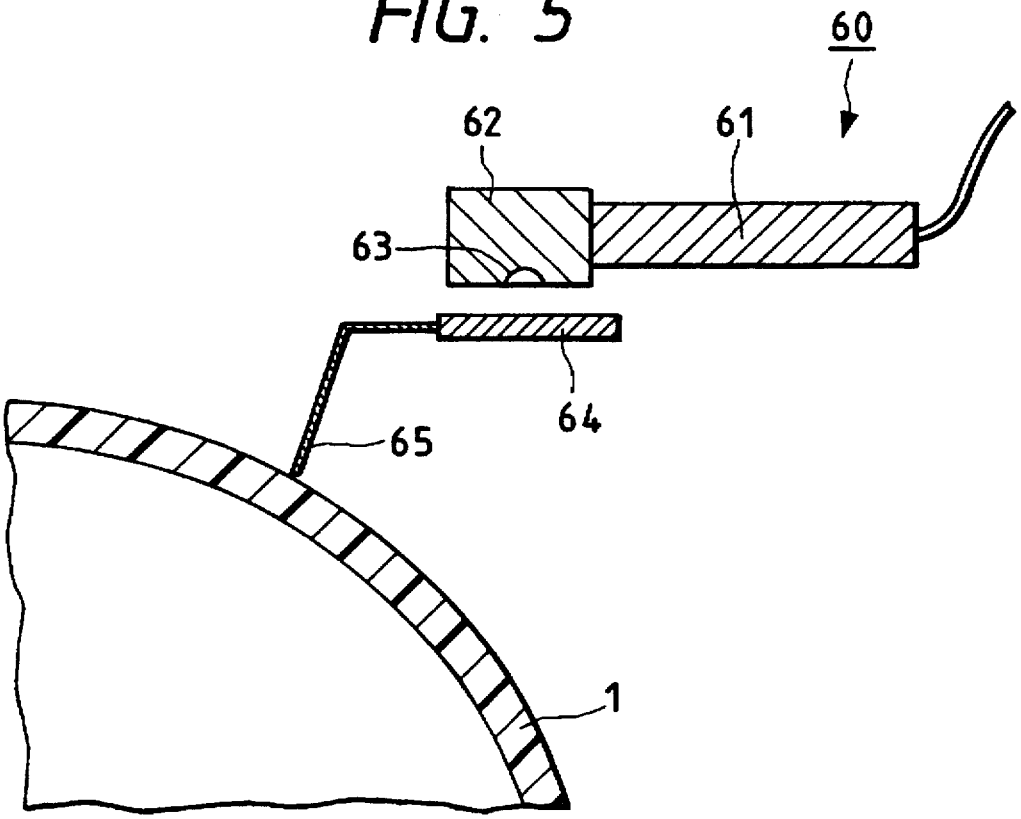
FIG. 5 shows a schematic sectional view of a pick-up probe for measuring the surface potential in a small region used in the examples regarding the present invention.

When printing is carried out by the use of a conventional fixing film in which carbon is dispersed, the electrostatic offset takes place sometimes, though the surface potential of the fixing film is sufficiently low. Thus, the surface potential in a small region on the fixing film was measured by the use of a probe as shown in FIG. 5, and as a result, it was confirmed that the very large turbulence of the potential was present in the small region. Particularly when the amount of added carbon was in the range of 0.1 to 1.5% by weight, the turbulence of the potential having an amplitude of 1 kV or more occurred. The reason why such a vigorous turbulence of the potential occurred is that the insulating regions of PFA or PTFE and the conductive regions of carbon exist together, and so the insulating regions are vigorously charged by friction with the papers and the conductive regions are in the state of 0 V. The size of each of the charged regions and the conductive regions is very small, and therefore when the surface potential is macroscopically measured, it is averaged and seems to be low. In fact, however, the potential in the vicinity of the film is very high, and the high and low potentials are mixed. If such a turbulence of the potential is present, the toner having a certain tribo is transferred to the film by virtue of an electrostatic force. Here, the tribo means a charge quantity which the toner has. When the amount of carbon is 0%, the turbulence of the potential does not occur in the small region because the conductive portions are not present, but the film is wholly charged. Therefore, if a positive charge is put on the film by some chance, the electrostatic offset vigorously takes place at this portion. Furthermore, when the surface layer is in an insulating state, the generation of the peeling electrostatic offset cannot be prevented.

On the other hand, if the amount of carbon to be added is more than 1.5% by weight, the insulating region of PFA or PTFE is substantially decreased, so that the turbulence of the microscopical potential decreases. However, when the surface is rich in carbon, the release properties of the fixing film deteriorate, and carbon peels off from the surface of the film by the feed of the papers for a long time, so that insulation portions are exposed and the electrostatic offset increases inconveniently. In addition, if the amount of carbon increases, the surface resistance value of the film deteriorates, and transfer charges on the transfer material begin to leak, so that similarly, the electrostatic offset increases inconveniently.

These problems are all caused by the poor dispersibility of carbon. The primary average particle diameter of KETJEN BLACK is about 0.03 μm, and therefore, if the KETJEN BLACK is uniformly dispersed, the turbulence of the potential does not occur on the surface of the fixing film. Furthermore, if the necessary and minimum amount of carbon is uniformly dispersed, the leakage of the transfer charges does not occur, so that the charging of the fixing film can be prevented. Moreover, if carbon is uniformly dispersed, the resistance value of the film does not fluctuate at the time of the manufacture, which enables the stable manufacture. However, it is difficult to uniformly disperse carbon and maintain its primary average particle diameter in order not to form the so-called aggregates by a present technique. Thus, for the regulation of the resistance value of the surface layer of the fixing film, the ion-conductive electrical resistance value controlling material is used. In General, the ion-conductive material which can be used for the prevention of charging and the regulation of the resistance value is an organic material typified by a surface active agent. If used as the surface layer material of the fixing film, the organic material decomposes and volatilizes, as printing is carried out at a temperature at which the fixing device is used, and it cannot play the role of the resistance value controlling material any more after its durable term.

In the present invention, therefore, the ion-conductive material having the melting point higher than the maximum temperature which the fixing device uses is used to control the resistance value of the fixing film or the fixing roller.

The fixing temperature depends upon a process speed and characteristics of the toner to be used, but it is usually about 200° C.

Examples of the ion-conductive material which does not change, decompose and volatilize even at this temperature include Hishicolin (trade name) made by The Nippon Chemical Industrial Co., Ltd. and EFTOP (trade name) made by Mitsubishi Metal Corporation. Each of these materials can be uniformly mixed with the resin constituting the fixing film or the surface layer of the fixing roller to remove the electric charges from its surface and to impart the proper resistance value to the surface.

The above-mentioned phenomenons are observed not only in an on-demand type fixing device but also in a conventional heated roller fixing device. Therefore, needless to say, also in the case that the surface of the fixing roller is similarly treated to regulate its resistance value, it is effective to use the above-mentioned ion-conductive electrical resistance value controlling material.

A polyimide seamless film which can be used in the present invention can be obtained, for example, by casting, onto the surface of a cylinder, a polyimide precursor obtained by reacting an aromatic tetracarboxylic acid component with an aromatic diamine component in an organic polar solvent, thermally treating the cast material, and then subjecting the treated material to a dehydration/condereaction reaction. No particular restriction is put on the aromatic tetracarboxylic acid component, and examples of the aromatic tetracarboxylic acid component include 3,3', 4,4'-biphenyltetracarboxylic dianhydride, 2,3', 4,4'-benzophenonetetracarboxylic dianhydride, pyromellitic dianhydride and mixtures of these tetracarboxylic acids. No particular restriction is put on the above-mentioned aromatic diamine component, and examples of the aromatic diamine component include diphenyl ether-based diamines such as 3,3'-diaminophenyl ether, 3,3'-dimethoxy-4,4'-diaminodiphenyl ether and 4,4'-diaminophenyl ether, diphenyl thioether-based diamines such as 3,3'-diphenyl thioether and 4,4'-diaminodiphenyl thioether, benzophenone-based diamines such as 4,4'-diaminobenzophenone, diphenylmethane-based diamineparaphenylenediamines and metaphenylenediamines. Furthermore, examples of the organic polar solvent include N-methylpyrrolidone, dimethylformamide, dimethylacetamide, phenol, o-cresol, m-cresol, p-cresol and dimethyl oxide, but they are not particularly restrictive.

In addition, examples of the fluorine-containing resin include polytetrafluoroethylene (PTFE), ethylene tetrafluoride-perfluoroalkoxyethylene copolymer resin (PFA), tetrafluoroethylene-hexafluoropropylene copolymer resin (PFEP), ethylene-tetrafluoroethylene copolymer resin (PETFE), ethylene-chlorotrifluoroethylene copolymer resin (PECTFE) and polyvinylidene fluoride (PVdF).

Next, the present invention will be described in detail with reference to examples.

EXAMPLE 1

Figure 2:
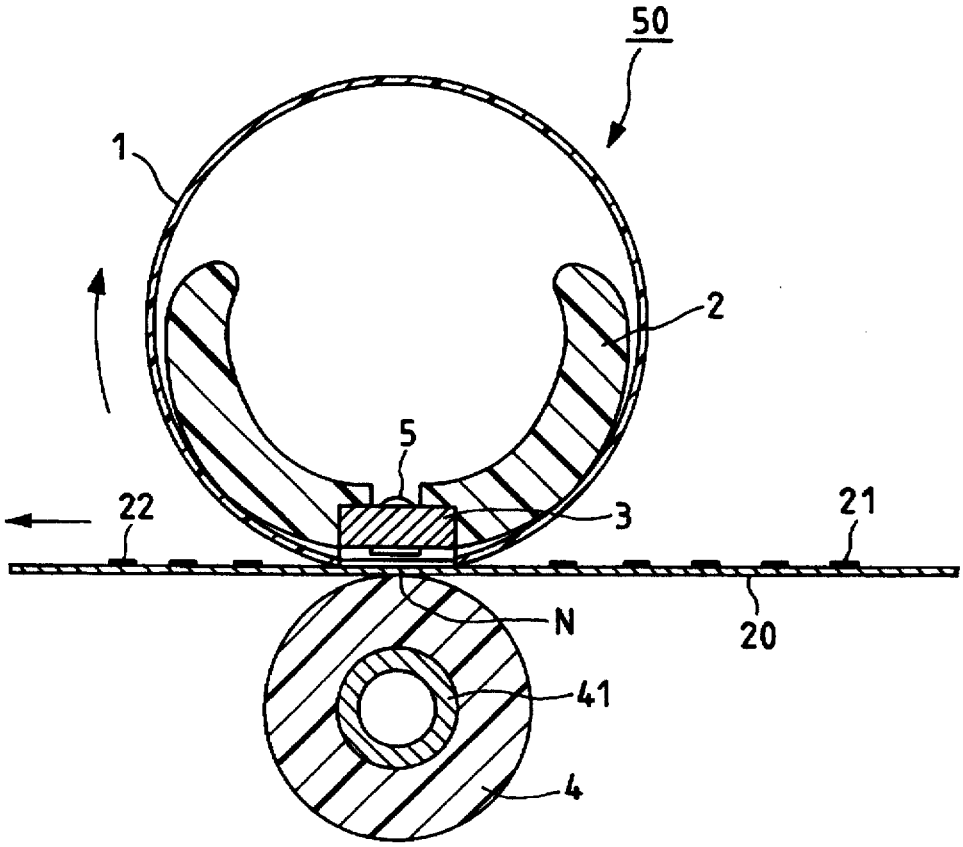
FIG. 2 shows a schematic sectional view of the constitution of an on-demand type fixing device regarding one embodiment of the present invention.

In this example, an on-demand type fixing device was used as a fixing device. Its schematic view is shown in FIG. 2. The fixing device 50 comprises a heating portion and a press roller, and the heating portion is constituted of a fixing film 1, a ceramic heater 3 and a film guide 2. The fixing device is driven by the press roller 4, and a transfer material (a paper) 20 and the film 1 are also driven by the press roller 4. The heater 3 comprises a ceramic substrate and a heating paste printed on the substrate, and the heater 3 generates heat by passing a power-controlled AC current therethrough. The heating pattern is coated with a glass in order to secure protection and insulating properties. A chip thermistor 5 is attached to the back surface of the ceramic substrate, whereby the feed of the electric current is controlled on the basis of a detected temperature. The film guide 2 is made of a thermosetting plastic and its undersurface has a structure for receiving the heater, and the fixing film 1 is moved along the film guide 2. The transfer material (the paper) 20 to which a toner 21 adheres is fed from the right-hand side in FIG. 2 and heated at a nip point N between the heater 3 and the press roller 4, and the transfer material having a fixed image 22 is then discharged to the left-hand side in FIG. 2.

The press roller comprises a core 41 and a silicone rubber 4 molded around the core 41, and the diameter and the length of the press roller are 20 mm and 220 mm, respectively. The silicone rubber is made of a two-part liquid system addition type LTV silicone, and in order to prevent its surface from charging up, 1% by weight of a surface active agent is added to the rubber. The core of the press roller is connected to an earth.

Next, the fixing film 1 will be described. The fixing film 1 is constituted of three layers, and a base layer which is one of the three layers is a cylindrical polyimide film having a thickness of 50 μm and an outer diameter of 24 mm. The base layer slides on the heater, and so wear resistance, strength and the like are required for the base layer. For this reason, the polyimide is used as the material for the base layer. A conductive primer layer is mounted on this base layer. This conductive primer layer is used to prevent an offset inducing potential from spreading on the surface of the film owing to an AC electric field generated by passing the current through the heater pattern and owing to charging generated by friction between the heater and the inside surface of the film, and to secure the adhesion between the above-mentioned polyimide and the surface layer of the undermentioned release layer. At the end portion of the film, the conductive primer layer remains exposed, and the exposed portion is connected to the earth to regulate the potential of the conductive primer layer to 0 V, whereby the potential of the film is stabilized.

The release layer is mounted on this conductive primer layer. The release layer is required to withstand the slide on the transfer material and to have such high release properties that the toner does not adhere thereto. As a material for the release layer, an aqueous dispersion obtained by mixing PTFE with PFA at a ratio of 7:3 is used. In this example, this dispersion is mixed with 10% by weight of Hishicolin PX-2B (trade name, made by The Nippon Chemical Industrial Co., Ltd.) as a resistance value regulator, which is an organic phosphorus-containing compound (a bromine salt of tetraethylphosphonium) represented by $(C_2H_5)_4P.Br$. When Hishicolin PX-2B is used, positive phosphorus ions mainly migrate to impart conductive properties to the release layer. Incidentally, Hishicolin PX-2B is easily soluble in water. Hishicolin PX-2B has a boiling point of 333° C., and this boiling point is higher than about 200° C. which is a maximum temperature in the fixing device to be used. Therefore, Hishicolin PX-2B neither decomposes nor volatilizes during the durable term of paper feed, and even after the durable term, the same resistance value as in an initial stage can be maintained.

The materials of the conductive primer layer and the release layer are applied onto the polyimide film which is the base layer by dipping, and they are dried, and then baked. The thickness of the conductive primer layer is about 5 μm, and that of the release layer is about 10 μm.

The thus molded fixing film has a uniform resistance value distribution, because the resistance value of the release layer constituting the surface of the fixing film is due to ions which are conductive. The surface resistance value of the film containing 10% by weight of Hishicolin at an application of 10 V was measured by means of a high resistance meter Hirestor made by Mitsubishi Petrochemical Co., Ltd., and as a result, it was $1\times10^{10}$ Ω/□.

Next, for comparison, a conventional film release layer was prepared as a comparative example. In this comparative example, as a resistance value controlling material for the release layer, carbon was used in place of Hishicolin. Concretely, Lion Paste W•310A made by The Lion Co., Ltd. in which KETJEN BLACK was dispersed in water was added to a fluorine-containing resin in an amount of 0% by weight, 0.7% by weight and 1.5% by weight based on the weight of the resin, and the resins containing the KETJEN BLACK were then calcined to prepare samples, i.e., a sample A, a sample B and a sample C, respectively.

The surface resistance values of the thus prepared films were $1\times10^{13}$ Ω/□ (0% by weight) in the sample A, $1\times10^{10}$ Ω/□ (0.7% by weight) in the sample B and $1\times10^{5}$ Ω/□ (1.5% by weight) in the sample C.

Figure 3:
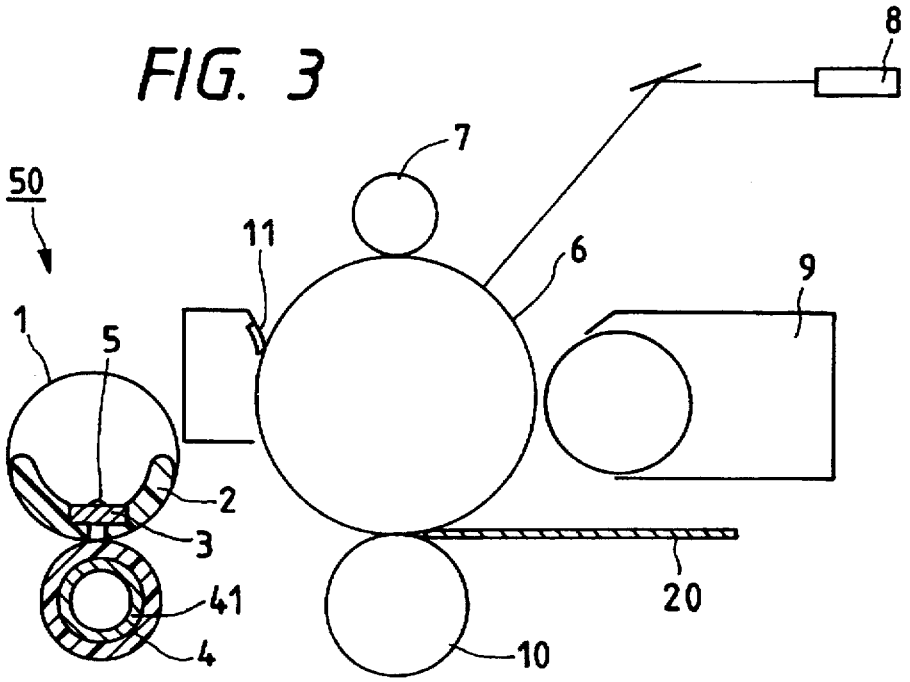
FIG. 3 shows a schematic sectional view of an electrophotographic printer used in Example 1 regarding the present invention.

For these samples, potentials were measured and images were evaluated. For the evaluation of the images, such an electrophotographic printer as shown in FIG. 3 was used. A photosensitive drum 6 is a negatively charged OPC photosensitive drum having a diameter of 24 mm. In the first place, the photosensitive drum 6 is uniformly charged to 650 V by a charging roller 7, and an image portion on the photosensitive drum 6 is then exposed to light by a laser exposing device 8 to remove the charges from the portion. Afterward, reversal development is carried out with a negatively charged one-component magnetic toner by a developing section 9. This developing 10 section 9 utilizes a non-contact jumping development system, and the overlap of a DC voltage of 500 V and an AC voltage of 1600 Vpp, 1800 Hz and a rectangular waveform is applied to a developing sleeve. Next, the thus developed toner image is transferred to a transfer material 20 by a transfer roller 10 to which +2 kV is applied, and then forwarded to a fixing device 50. After the transfer operation, the remaining toner on the photosensitive drum 6 is removed therefrom by a cleaning section 11, and the cleaned photosensitive drum 6 is ready for the next image formation.

An experiment was carried out to evaluate the total surface offset and the peeling offset of the image and to measure the surface potential of the fixing film and an electric current which flowed through the fixing film. Particularly, with regard to the surface potential of the fixing film, the measurement was made in a microscopical region. Concretely, as shown in FIG. 5, a pick-up probe was attached to a model 344 surface electrometer 60 made by Trek Co., Ltd., and in the microscopical region which was in contact with the tip of a conductive needle 65, the measurement was performed. In this pick-up probe, a potential on the surface of the fixing film is induced onto a pick-up plate by the conductive needle, and this potential is then measured in a non-contact manner. In FIG. 5, reference numeral 61 is a surface electrometer probe, numeral 62 is a pick-up probe for the microscopical region potential measurement, 63 is a site to be measured, and 64 is a metallic plate.

First, a film obtained by a conventional preparation method was evaluated.

For the sample A in which the amount of carbon to be added was 0%, i.e., for the insulating film, the image was evaluated. As a result, it was apparent that as papers were fed, the total surface offset increased, and the peeling offset accumulated and often appeared. At this time, with regard to the potential on the surface of the fixing film, as shown in FIG. 1A, its absolute value shifts to a plus side as the papers are fed, and a peak which represents the peeling offset also increases.

As the papers are fed, the positive charges for the transfer which are held by the transfer material are transferred onto the film. However, since the film is in the insulating state, any refuge for the positive charges is not present, so that the film is gradually charged up and finally the total surface offset occurs. In addition, when the transfer material passes through the fixing device, the rear end of the transfer material rebounds to strongly come in contact with the fixing film, so that a sharp potential peak appears. This peak does not attenuate because of the fixing film being insulating, and it also causes the peeling offset.

As understood from the foregoing, the insulating film cannot attenuate the positive charges generated on the fixing film, and in consequence, the occurrence of the electrostatic offset cannot be prevented.

Next, for the sample C to which 1.5% by weight of carbon was added, a similar experiment was carried out. As a result, the weak total surface offset occurred from the first fed paper. Even when the papers were successively fed, the level of the total surface offset was constant, and any peeling offset did not occur. It is apparent from FIG. 1C that the potential of the fixing film is almost 0 V and any problem regarding the surface potential is not present. However, it is observed that an electric current of 0.1 μA flows from the fixing film to the earth, and so it can be presumed that the transfer charges flows from the transfer material thereinto, so that the charges for holding the toner on a transfer member are lost. Thus, it can be considered that this phenomenon causes the weak total surface offset. Therefore, if the surface resistance value of the fixing film is too low, the transfer charges are leaked inconveniently, which results in the generation of the total surface offset.

Next, for the sample B to which 0.7% by weight of carbon was added, an experiment was carried out. The total surface offset began to occur, as the papers were fed, and the peeling offset also took place, though it was slight. At this time, the potential of the fixing film is about 0 V on the average as shown in FIG. 1B, but some peaks having a large amplitude are observed. This indicates that carbon is not uniformly dispersed, and in a microscopical region on the fixing film, it is observed that conductive regions and insulating regions exist together. The insulating regions are positively charged with the positive charges from the transfer material, as the papers are fed. On the other hand, the conductive regions have 0 V, because they are connected to the earth through carbon structures. In the case that the regions having the different potentials are adjacent to each other with the interposition of a slight space, a very large electric field occurs therebetween, and by this electric field, the toner flies and transfers to the fixing film inconveniently. In this connection, the electric current which flows through the fixing film is as small as in a measurement error range, and $1\times10^{10}$ Ω/□ which is a macroscopic surface resistance value at the addition of 0.7% by weight of carbon is considered to be a proper value.

Next, for a film to which 10% by weight of an ion-conductive resistance value controlling material "Hishicolin PX-2B " regarding this example was added, an experiment was made.

During a paper feed operation of from the first paper to the completion of a durable term, neither the total surface offset nor peeling offset took place, and good images were obtained. At this time, the potential on the surface of the fixing film was microscopically uniform and it was almost 0 V, as shown in FIG. 1C. Furthermore, the macroscopic surface resistance value of the fixing film was $1\times10^{10}$ Ω/□ as described above, and the leakage of the electric charges from the transfer material was not measured, either.

The ion-conductive resistance value controlling material is easily affected by environmental requirements such as temperature and humidity, and for precaution's sake, a similar image evaluation and measurement were carried out under a high-temperature high-humidity environment in which a temperature was 32.5° C. and a relative humidity was 85% as well as a low-temperature low-humidity environment in which the temperature was 15° C., and the relative humidity was 10%, but any problem was not present. This reason is that the fixing film is warmed by the heater at the time of printing and the fixing film is used at a constant temperature, and therefore, the resistance value is constant under any circumstances in the vicinity of a fixing nip where the electrostatic offset occurs.

As described above, in this example, it was confirmed that in the on-demand type fixing device in which the ceramic heater and the film were used, the ion-conductive resistance value controlling material was used in the film surface to prevent the charging, whereby such a charge-up as generated the electrostatic offset could be prevented and such a resistance value as prevented the leakage of the electric charges from the transfer material could be maintained.

EXAMPLE 2

Figure 4:
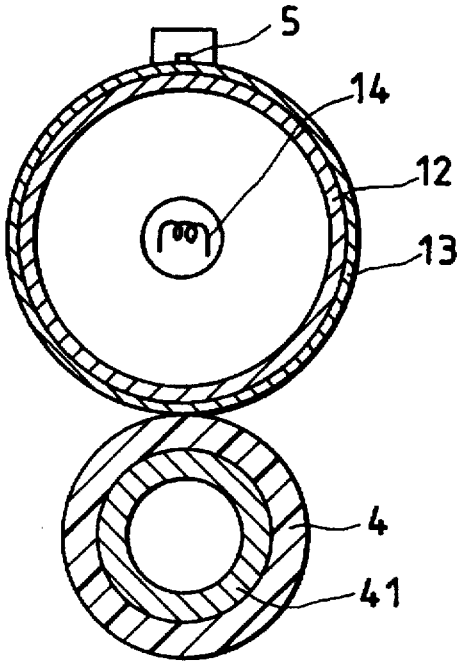
FIG. 4 shows a schematic sectional view of a heated roller fixing device used in Example 2 regarding the present invention.

In this example, a heated roller type fixing device is used. The constitution of an electrophotographic printer which is used in this example is the same as in Example 1 except for the fixing device alone. The schematic view of the heated roller type fixing device which is used in this example is shown in FIG. 4. A press roller 4 is the same as used in Example 1, and so its description will be omitted. A base material 12 of a fixing roller is an aluminum cylinder having an outer diameter of 30 mm, a wall thickness of 2 mm and a length of 240 mm, and it has a halogen heater 14 of 500 W therein. On the opposite side of a nip between the press roller and the base material 12 of the fixing roller, i.e., in a hollow portion of the base material 12 of the fixing roller, a contact type thermistor 5 is arranged, and this thermistor 5 detects the temperature of the base material 12 of the fixing roller to control the switch of the halogen heater. On the surface of the base material 12 of the fixing roller, a coating film 13 of PFA/PTFE is formed. The base material 12 of the fixing roller is the stiff aluminum cylinder, and a release layer can be formed by mixing the dispersion of PFA/PTFE with a resistance value controlling material, and then calcining the mixture.

Heretofore, in order to prevent the leakage of the transfer charges from the fixing roller, the surface resistance value of the fixing roller has been required to $1\times10^{6}$ Ω/□ or more, and the desired resistance value has been attained by dispersing 0.7% by weight of carbon.

After the formation of the coating film, however, the resistance value largely changes sometimes owing to a temperature at coating, a dispersion state, the storage state of a coating solution and a humidity at drying. Therefore, there are a problem that stability at the time of manufacture is poor and a problem that the regulation of the resistance value is difficult. These problems are caused by the alteration of the dispersion state of carbon in the coating solution due to various factors, and once carbon aggregates, it cannot be dispersed to its primary particles again. In this example, therefore, there is used an ion-conductive resistance value controlling material in which the resistance value does not vary with dispersibility in contrast to a filler such as carbon, whereby the manufacture stability can be secured.

The ion-conductive material is not dispersed in the coating solution but dissolved in an ionic state therein, and therefore it is not localized. Thus, even if a specific mixing means is not used, the material can be stabilized in a low entholopy state, and so even if a solution is newly reprepared, a concentration unevenness does not occur. However, in a fixing film made of the ion-conductive material, the quality of the ion-conductive material should not be changed and the ion-conductive material should not be volatilized, even after papers are fed for a durable term. Therefore, in this example, there is used the ion-conductive material having a melting point higher than a maximum temperature which the fixing device uses.

Examples of such a material include Hishicolin which is an organic phosphorus salt referred to in Example 1 and other compounds, but in this example, EFTOP Grade EF-102 (trade name, made by Mitsubishi Metal Corporation) was used. The amount of EF-102 to be used was 5% by weight based on the weight of a solid content of a PFA/PTFE dispersion. The material EF-102 is a fluorine-containing surface active agent represented by $RfSO_3K$ (potassium perfluoroalkylsulfonate in which the number of carbon atoms of the alkyl group is in the range of 1 to 30), and its melting point is as high as 420° C. Therefore, even at the time of the manufacture and even in a durability test at a fixing temperature, the quality of EF-102 does not change and EF-102 does not volatilize, and so the resistance value of the fixing film can be stably maintained.

Hishicolin referred to in Example 1 and EFTOP are water-soluble, and therefore at the time of the manufacture, EFTOP can be dissolved in the PFA/PTFE dispersion without any problem. Since it is not necessary to take a pH value of the solution into consideration, the concentration of the solution can be easily controlled. In addition, since EFTOP does not precipitate during the storage of the solution and the like in contrast to carbon, a pot life of the coating solution can be prolonged, which can make the state of the coating solution stable.

The fixing roller containing mixed EFTOP was used to output images. In this case, a uniform surface resistance of $1\times10^{10}$ Ω/□ or more could be obtained, and in consequence, neither a total surface offset, nor a peeling offset, nor the leakage of transfer charges took place and the good images could be output throughout the whole circumstances and a durable term.

As described above, when the ion-conductive fluorine-containing surface active agent is used as the resistance value controlling material for the surface of the fixing roller, there can be controlled the fluctuation of the resistance value under conditions at the manufacture. Furthermore, since the resistance value controlling material having a melting point higher than a maximum temperature in the fixing device is used, the fixing roller can be obtained which does not generate any electrostatic offset even after the completion of the durable term.

What is claimed is:

1. A fixing device for heating and melting a toner image and fixing it onto a transfer material, said fixing device having a fixing member surface which comes in contact with the toner image, said fixing member surface comprising at least a resin and an ion-conductive electrical resistance value controlling material having a melting point higher than a maximum temperature in the fixing device, wherein the surface electric resistance of the fixing member is in the range of $1\times10^{6}$ Ω/□ to $1\times10^{14}$ Ω/□.

2. The fixing device according to claim 1 wherein said ion-conductive material is at least one selected from the group consisting of organic phosphorus salts and organic salts having perfluoroalkyl groups.

3. The fixing device according to claim 1 wherein said ion-conductive electrical resistance value controlling material is present in a dispersing state in an amount of 0.1 to 40% by weight based on the resin.

4. The fixing device according to claim 1, 2 or 3 wherein said resin is a fluorine-containing resin.

5. The fixing device according to claim 1 wherein the surface of the fixing member is provided with a surface layer containing at least the resin and the ion-conductive electrical resistance value controlling material.

6. The fixing device according to claim 5 wherein the surface layer is formed on a heat-resistance film.

7. The fixing device according to claim 6 wherein the heat-resistant film is a polyimide film.

8. The fixing device according to claim 1 wherein the thickness of the surface layer of the fixing member is in the range of 1 to 50 μm.

9. The fixing device according to claim 5, or 8 wherein the resin contained in the surface of the fixing member is a fluorine-containing resin.

10. The fixing device according to claim 1 wherein said fixing device is constituted of an elastic press roller and a heating apparatus comprising a film and a heater, and the surface of the film comprises at least the resin and the ion-conductive electrical resistance value controlling material having the melting point higher than the maximum temperature in the fixing device.

11. The fixing device according to claim 1 wherein said fixing device is a heated roller fixing device, and the surface of the heated roller comprises at least the resin and the ion-conductive electrical resistance value controlling material having the melting point higher than the maximum temperature in the fixing device.

12. The fixing device according to claim 10 or 11 wherein said resin is a fluorine-containing resin.

13. A film which comprises a heat-resistant resin whose surface containing an ion-conductive electrical resistance value controlling material, wherein the surface electric resistance of the film is in the range of $1\times10^{6}$ Ω/□ to $1\times10^{14}$ Ω/□.

14. The film according to claim 13 wherein said heat-resistance resin is a fluorine-containing resin.

15. The film according to claim 13 wherein said ion-conductive electrical resistance value controlling material is at least one selected from the group consisting of organic phosphorus salts and organic salts having perfluoroalkyl groups.

* * * * *

UNITED STATES PATENT AND TRADEMARK OFFICE

CERTIFICATE OF CORRECTION

PATENT NO. : 5,697,037
DATED : December 9, 1997
INVENTOR(S) : Hideyuki YANO, et al.

It is certified that error appears in the above-indentified patent and that said Letters Patent is hereby corrected as shown below:

Column 2, line 59, delete "phenomenons" and insert therefor --phenomena--.

Column 4, line 10, delete "1to" and insert therefor --1 to--;
Line 20, "Ω/□ *to*" should not be superscripted;
Line 24, delete "number," and insert therefor --member,--.

Column 7, line 13, delete "phenomenons" and insert therefor --phenomena--;
Line 27, delete "condereaction" and insert therefor --condensation--.

Column 9, line 35, delete "10".

Column 11, line 59, after "to", insert --be--.

Column 13, line 23, delete "resistance" and insert therefor --resistant--;
Line 29, after "5", delete the comma (",").

Signed and Sealed this

FourthDay of August, 1998

Bruce Lehman

*Attest:*

BRUCE LEHMAN

*Attesting Officer*

*Commissioner of Patents and Trademarks*